US005578343A

United States Patent [19]

Gaeta et al.

[11] Patent Number: 5,578,343

[45] Date of Patent: Nov. 26, 1996

[54] MESH-BACKED ABRASIVE PRODUCTS

[75] Inventors: Anthony C. Gaeta, Rockport; Gwo S. Swei, East Amherst; Neil W. Durkee, Clifton Park, all of N.Y.

[73] Assignee: Norton Company, Worcester, Mass.

[21] Appl. No.: 476,161

[22] Filed: Jun. 7, 1995

[51] Int. Cl.[6] ..... B05D 1/36; B05D 5/02; C08J 5/14

[52] U.S. Cl. ..... 427/202; 427/203; 427/204; 51/298

[58] Field of Search ..... 427/202, 203, 427/204; 51/298

[56] References Cited

U.S. PATENT DOCUMENTS

| | | | |
|---|---|---|---|
| 3,861,892 | 1/1975 | Wisdom, Jr. et al. | 51/295 |
| 4,047,903 | 9/1977 | Hesse et al. | 51/298 |
| 4,143,013 | 3/1979 | Jenkinson et al. | 260/29.1 SB |
| 4,457,766 | 7/1984 | Caul | 51/298 |
| 4,547,204 | 10/1985 | Caul | 51/298 |
| 4,588,419 | 5/1986 | Caul et al. | 51/295 |
| 4,903,440 | 2/1990 | Larson et al. | 51/298 |
| 4,927,431 | 5/1990 | Buchanan et al. | 51/298 |
| 5,055,113 | 10/1991 | Larson et al. | 51/298 |
| 5,236,472 | 8/1993 | Kirk et al. | 51/298 |
| 5,344,688 | 9/1994 | Peterson et al. | 428/102 |

*Primary Examiner*—Shrive Beck
*Assistant Examiner*—Fred J. Parker
*Attorney, Agent, or Firm*—David Bennett

[57] ABSTRACT

A mesh backed coated abrasive product is provided that has a binder coat that can be partially cured by radiation and finally cured at the same time as a size applied over the top of the maker coat. The use of the radiation curable binder permits the elimination of fabric pre-treatment and speeds the production process considerably.

11 Claims, No Drawings

MESH-BACKED ABRASIVE PRODUCTS

BACKGROUND TO THE INVENTION

The present invention relates to the production of coated abrasives and particularly to the production of coated abrasives having a mesh backing. For the purposes of this invention a mesh is to be distinguished from other fabrics by the area of open space, (that is the space not occupied by the yarn), per unit area. In a mesh product the open space represents at least about 20% of the surface area of the fabric. These mesh-backed products are used in the form of discs, sheets or belts for rough cleaning operations such as floor sanding and cleaning of grills. The products are based on an open woven or knit structure, with leno weave and raschel or marquisette knits being the most frequently used. These have the appearance of screens rather than cloths and it is important that they retain this screen appearance, and hence porosity, even when formed into the final abrasive product. The mesh of the untreated backing is therefore very open with voids representing at least about 20% and more preferably at least 30% of the surface area of the untreated backing. Typically there are from about 12 to 25 yarns per inch in both the warp and cross directions using yarns with a denier from about 70 to about 600. Clearly the thicker yarns are used when the number of yarns per inch is at the lower end of the range to preserve the open character of the mesh. Typical structures have the following characteristics:

| | | DENIER | |
|---|---|---|---|
| STYLE | YARNS/INCH | WARP | CROSS |
| marquisette/leno | 15 × 15 | 420, | 600 |
| marquisette | 24 × 24 | 140, | 260 |
| marquisette | 18 × 18 | 210, | 420 |
| raschel | 13 × 16 | 70, | 70 |

Typically the greige mesh material is pre-treated with a finish, such as one based on an acrylic polymer, to make it stiffer and to protect it against the phenolic resin commonly used as the maker coat which renders the fabric brittle. After the finish has been applied and dried, the mesh is given a maker coat followed by the application of abrasive grain, usually by electrostatic deposition. The maker coat is then at least partially cured and a size coat is applied. This too is cured. The sequential drying or curing of the finish, maker and size treatments typically stretches into many hours and this means that very large volumes of "goods in process" need to be maintained. This is particularly true when the maker and size coats are based on phenolic resins as is most frequently the case.

It has now been found possible to compress these operations considerably and even eliminate the mesh pre-treatment, or "finishing", operation altogether. This permits a much more streamlined operation without sacrifice in the quality of the product obtained. The present invention therefore provides a way to produce high-quality, mesh-backed products by an efficient abbreviated process.

DESCRIPTION OF THE INVENTION

The present invention provides a process for the production of a mesh-backed abrasive material which comprises:

a) coating an unfinished mesh fabric with a maker coat comprising a binder having at least one radiation-curable group;

b) applying a coating of abrasive grain to the maker coat;

c) radiation-curing the maker coat at least to the point at which the binder becomes solid; and d) applying a size coat comprising a thermally-curable resin; and e) completing the cure of both maker and size coats.

It has been discovered that the radiation curable binder used in the maker coat also adequately strengthens the mesh making it possible to dispense with the cloth finishing operation and use an "unfinished" mesh. Since the maker coat is applied directly to the mesh and the coating and curing stages follow directly, the mesh achieves the necessary stiffness for easy handling before it has to be manipulated through drying systems. Finally since a phenolic resin is not applied directly to the mesh, there is no protective function for a cloth finish to perform.

The radiation curable binder can be any one of those that have been described in the art for use in coated abrasives. These include acrylic polymers, epoxy-acrylates, acrylated polyurethanes, polyesterurethanes, unsaturated polyesters and epoxy-novolacs. The most preferred polymers have a dual functionality comprising at least one first functionality or group that is radiation curable and at least one second functionality or group that is curable by a different mechanism. Since the size layer comprises a binder that is thermally-curable, it is highly preferred that the second functionality is cured by the same means, that is, by the application of heat. Thus the completion of the cure of the maker coat and the cure of the size coat are preferably achieved simultaneously. The second functionality is also preferably a group, (for example an epoxy group), that is reactive with active hydrogen-containing groups than can bond directly to such groups in the binder component of the size layer as it cures, thus ensuring an excellent level of product integrity. The preferred binder component is described being "bi-functional" and by this intended that the binder contain two different types of functional groups that cure by different mechanisms. It is however contemplated the each molecule of binder may have more than one, for example from 1 to 3 or even more of each type of functional group. Preferred binders however have one of both kinds of functional group.

According to a further aspect of this invention, the partial cure of the bi-functional binder is followed by deposition of a phenolic size coat which is then thermally cured at the same time as the cure of the bi-functional binder is completed.

A further aspect of the invention is the use of a maker coat that comprises a bi-functional compound having at least one radiation-curable function and at least one thermally-curable function, wherein the compound is a liquid in the uncured state. Since the maker is itself a liquid, no solvent need be removed before curing can be initiated, thus greatly accelerating the curing process. Such formulations are referred to as having 100% solids, indicating thereby that no weight is lost upon cure.

The binder layer comprising the bifunctional component may also be applied as a size coat, that is, over the top of a layer of abrasive particles adhered to the backing by means of a maker coat that also comprises a bi-functional binder component.

The preferred bi-functional compound comprises at least one and often as many as three or more radiation-curable functions, by which is meant groups that react with similar groups when activated by radiation such as UV light or an electron beam. The reaction may be initiated by free-radical or cationic initiation and of course different species of initiators or promoters are applicable in each case. Typical radiation-curable functions include unsaturated groups such as vinyl, acrylates, methacrylates, ethacrylates, cycloaliphatic epoxides and the like. The preferred UV-curable functions are acrylate groups. Where the bi-functional compound comprises a single UV-curable group, it may be desirable to incorporate a minor amount of a further compound containing groups reactive with the UV-curable group such di-acrylates, tri-acrylates and N-vinylpyrrolidone. Suitable reactive diluents include trimethylol propane triacrylate, (TMPTA); triethylene glycol diacrylate (TRPGDA); hexane diol-diacrylate, (HDODA); tetraethylene glycol diacrylate, (TTEGDA); N-vinyl pyrrolidone (NVP); N-vinyl formamide (NVF); and mixtures thereof. Such additives are very effective in adjusting initial viscosity and determining the flexibility of the cured formulation. They may be added in amounts up to about 50% by weight. This permits control over the formulation viscosity, the degree of cure and the physical properties of the partially cured bi-functional compound. In addition it is preferred that such added reactive compounds be liquid or soluble in the mixture as to add no solvent that needs to be removed prior to cure.

Cure by means of radiation treatment is usually sufficient to ensure adequate retention of the abrasive grains during subsequent processing before curing of the thermally curable functions is completed. UV-radiation is the preferred curing means for the radiation curable functionality.

The thermally-curable function may be provided for example by epoxy groups, amine groups, urethanes or unsaturated polyesters. The preferred thermally curable function is however the epoxy group since this will result in a plurality of terminal hydroxyl groups on the cured binder which would ensure that a size coat deposited thereon and comprising a resin that will react with the active-hydrogen containing groups remaining after crosslinking of the epoxy groups such as phenolics, urea/formaldehyde resins and epoxy resins would bond firmly thereto. This decreases the risk of de-lamination during use.

Cure of the thermally-curable functions is preferably accelerated or promoted by the addition of known catalysts such as peroxides or 2-methyl-imidazole.

The backbone of the bifunctional binder is not critical beyond providing a stable, essentially non-reactive support for the functional groups that does not interfere with the cure reactions. A suitable backbone is based on a bisphenol derivative such as bisphenol A or bisphenol E. Other possible backbones may be provided by novolacs, urethanes, epoxy-novolacs and polyesters.

These backbone compounds can be reacted by known techniques to form terminal epoxide groups which are of course thermally curable. Such epoxidized backbone materials are well-known. To obtain the bi-functional binder components of the invention this epoxidized derivative is then reacted with a compound containing a function that is reactable with the epoxide function and also contains a radiation-curable function. The amount of the compound added is less than the stoichiometric amount that is required to react with all the epoxide functions present in the molecule. A typical compound may contain an acrylic or methacrylic group and an active-hydrogen containing group, and suitable examples include acrylic and methacrylic acids. The active hydrogen-containing group reacts with the epoxide group, replacing that (thermally-curable) functionality with a (radiation-curable) (meth)acrylate functionality.

The relative amounts of the epoxidized backbone and the radiation curable compound are important in that they control the relative degrees of curing that can occur in the radiation and thermal curing phases of the complete cure of the bi-functional binder compound. Usually the ratio of thermally curable groups to radiation-curable groups in the bifunctional binder is from 1:2 to 2:1 and most preferably about 1:1.

It is often desirable to incorporate in the maker coat a reaction promoter activatable at the temperatures at which the size coat is cured. Examples of such reaction promoters include for example 2-methylimidazole (2MI), t-butyl hydroperoxide and the like.

The abrasive grain can be applied by electrostatic techniques or by a simple gravity feed or even a combination of both. The preferred coating technique however employs electrostatic projection to deposit the grain on the backing.

The size coat is applied after the maker coat has been cured to a point at which the grain adhered thereto is held sufficiently securely to allow the size coat to be applied without substantial displacement or disorientation of the abrasive grits.

The size coat preferably comprises a phenolic resin and is most frequently a resole. Other resins that can be used however include urethanes, urea/formaldehydes, novolacs and epoxy resins. In general it is preferred that the size coat be compatible with the maker coat and, if a dual-functionality binder having a thermally curable functionality that is reactive with active hydrogen-containing groups, such as an epoxy group, is used in the maker coat, size coats in which the binder component comprises active hydrogen are preferred. This is because these will bond with the maker coat and produce a more integrated structure. The above-specified size coat options meet this requirement.

The size coat can in addition contain other conventional additives such as fillers and grinding aids. Fillers are preferably treated, for example with a silane, to give them more compatibility with the binder.

DESCRIPTION OF PREFERRED EMBODIMENTS OF THE INVENTION

The invention is now described with reference to specific embodiments which are presented as examples of the process of the invention and are not intended to imply any necessary limitation on the scope of the invention.

EXAMPLE 1

A polyester raschel knit mesh fabric having a weight of 77 gm/m$^2$, knit from a 70 denier yard and having a structure with 13×16 mesh/square inch, is treated with a maker coat of 30 gm/m$^2$ of Ebecryl 3605. This product, which is 100% solids, (that is, it contains no solvent), is available from UCB Chemicals under the above trade designation and comprises the reaction product of one molecule of diepoxylated bisphenol A with a molecule of acrylic acid. Its functional groups are an acrylate group at one end of the chain and an epoxy group at the other.

The treated mesh is passed into an electrostatic coater in which 188 gm/m$^2$ of 180 grit silicon carbide is applied. The grit is held by the maker as the coated mesh fabric passes beneath a source of UV light, (Fusion Co. 600 watt/inch H-Bulb), at a rate of 50 feet/minute. This causes the maker coat to harden and strengthen the grip on the abrasive particles.

From the UV treatment zone the coated mesh fabric passes directly between the nip of a pair of rolls at which 193 gm/m$^2$ of a phenolic size coat is applied.

The size coated mesh fabric is then dried and cured in a conventional oven to produce the finished product.

The mesh-backed coated abrasive obtained performed at least as well as products made using the same backing and abrasive but using phenolic maker and acrylic fabric pretreatment.

What is claimed is:

1. A process for the production of a mesh-backed abrasive material which comprises:

a) directly coating an unfinished greige mesh fabric in which at least 20% of the surface area is voids with a solvent-free liquid maker coat comprising a binder component consisting essentially of a bi-functional radiation-curable adhesive;

b) applying a coating of abrasive grain to the maker coat;

c) radiation-curing the maker coat at least to the point at which it becomes solidified; and d) applying a liquid size coat comprising a thermally curable resin over the abrasive grain; and e) completing the cure of both maker and size coats.

2. A process according to claim 1 in which each molecule of the radiation-curable adhesive has at least one radiation-curable group and at least one group that is thermally curable and reacts with the hydrogen in hydroxyl and/or amino groups.

3. A process according to claim 2 in which the group that is thermally curable is an epoxy group.

4. A process according to claim 1 in which the radiation-curable adhesive comprises a (meth)acrylate group.

5. A process according to claim 1 in which the cure of the radiation-curable adhesive is by means of UV-radiation.

6. A process according to claim 1 in which the size coat comprises a phenolic resin.

7. A process according to claim 1 in which the greige mesh fabric is selected from raschel or marquisette knit fabrics.

8. A process according to claim 1 in which the greige mesh fabric is selected from leno weave fabrics.

9. A process according to claim 1 in which the mesh fabric is made from a polymer selected from the group consisting of nylon and polyester.

10. A process for the production of a mesh-backed abrasive material which comprises:

a) directly coating an unfinished greige mesh fabric in which at least 20% of the surface area is voids with a solvent-free, liquid maker coat comprising a binder component consisting essentially of a bi-functional adhesive wherein one functionality is radiation-curable and the other is thermally curable;

b) applying a coating of abrasive grain to the maker coat;

c) curing the maker coat using UV-radiation at least to the point at which the radiation-curable functionality is at least partially cured; and d) applying a thermally curable phenolic size coat over the coating of abrasive grains; and e) completing the cure of both maker and size coats.

11. A process according to claim 10 in which the thermally curable functionality in the binder component of the maker coat is an epoxy group and the radiation-curable functionality is an acrylate group.

* * * * *